United States Patent [19]

Skinner et al.

[11] 4,066,123

[45] Jan. 3, 1978

[54] HYDRAULIC PUMPING UNIT WITH A VARIABLE SPEED TRIPLEX PUMP

[75] Inventors: David R. Skinner, Odessa; Marvin W. Jutus; Miles L. Sowell, both of Levelland, all of Tex.

[73] Assignee: Standard Oil Company (Indiana), Chicago, Ill.

[21] Appl. No.: 753,745

[22] Filed: Dec. 23, 1976

[51] Int. Cl.[2] ..... E21B 43/00

[52] U.S. Cl. ..... 166/68.5; 166/75 R

[58] Field of Search ..... 166/53, 67, 68, 68.5, 166/75, 105, 105.5; 417/77, 278, 279

[56] References Cited

U.S. PATENT DOCUMENTS

| | | | |
|---|---|---|---|
| 2,046,769 | 7/1936 | Coberly | 166/68.5 |
| 2,119,737 | 6/1938 | Coberly | 166/68.5 |
| 3,614,761 | 10/1971 | Rehm | 166/250 |
| 3,709,292 | 1/1973 | Palmour | 166/68 |
| 3,759,324 | 9/1973 | Mecusker | 166/75 |
| 3,782,463 | 1/1974 | Palmour | 166/68 |
| 3,802,501 | 4/1974 | Mecusker | 166/75 |
| 3,982,589 | 9/1976 | Wilson et al. | 166/53 |
| 3,982,591 | 9/1976 | Hamrick et al. | 166/53 |
| 3,982,592 | 9/1976 | Hamrick et al. | 166/53 |

*Primary Examiner*—James A. Leppink
*Attorney, Agent, or Firm*—Arthur McIlroy

[57] ABSTRACT

This invention is a hydraulic pumping unit which uses a cyclone feed pump means to vary the speed of the above-ground pump, while still providing proper cleaning of the power fluid for the downhole pump. The ability to conveniently change the speed of the above-ground pump allows the speed of the pump to be reduced whenever well conditions make such a reduction appropriate, and this provides a very substantial reduction in the cost of power for the prime mover (typically an electric motor). In addition to the cyclone feed pump and a speed control means to vary the speed at which the prime mover drives the above-ground pump, this invention uses a flowback line connected from the cyclone overflow to the feed pump inlet.

10 Claims, 2 Drawing Figures

HYDRAULIC PUMPING UNIT WITH A VARIABLE SPEED TRIPLEX PUMP

CROSS REFERENCES TO RELATED APPLICATIONS

Application Ser. No. 724,037, entitled "Downhole Pump Speed Control," filed Sept. 17, 1976, by Skinner, Sowell, and Justus, describes a control system for a hydraulic pumping unit which uses two fluid-flow metering means and controls the flow rate to the downhole pump to cause the power fluid flow rate to be maintained essentially directly proportional to the return fluid from the well. In this application, the power fluid flow rate is not varied to maintain any of the fluid flows constant, but, conversely, changes the power fluid flow rate in the same manner in which the return fluid flow has changed.

Application Ser. No. 724,060, entitled "Hydraulic Control System Underflow Valve Control, filed Sept. 17, 1976, by Skinner, Sowell, and Justus, discloses a system which controls the flow rates through the hydraulic pumping unit's cyclone separator to provide for self-cleaning of the cyclone underflow and good separation of solids in the cyclone and, at the same time, maintains a predetermined level of the liquid in the horizontal suction vessel. This copending application can be used with hydraulic pumping units in which the speed of the triplex pump is fairly constant (i.e., driven by a conventional AC motor), but does not allow the speed of the triplex pump to be varied over a wide range.

BACKGROUND OF THE INVENTION

This invention relates to hydraulic pumping systems for pumping well fluids, and more particularly to reducing the power consumption of such a hydraulic pumping unit.

Hydraulically actuated downhole pumps have been used rather than beam-pumping units in many locations. Hydraulic pumping units are especially attractive in the deeper and higher producing wells.

A hydraulic pumping unit uses a prime mover to drive an above-ground pump (typically, a triplex pump) and this pump supplies a flow of pressurized fluid, at least some of which pressurized fluid is used as power fluid for a downhole hydraulically actuated pump. The downhole pump returns to the surface fluid which is at least some of the power fluid together with produced well fluids. At least some of this return fluid is introduced into a cyclone separator which conditions some of this fluid and makes the conditioned fluid available to the above-ground pump for use as power fluid. The remainder of the cyclone flow (the portion containing the separated solids) is sent to a flowline, where this cyclone underflow and any return fluid which was not sent to the cyclone are combined to become the production from the well.

The speed of the downhole pump has been controlled by varying the amount of power fluid which is supplied to the downhole pump. As the triplex pump is generally driven directly by a conventional AC motor, the speed of such pump and therefore the flow therethrough is fairly constant. The pump speed in such systems will, of course, vary slightly with pump head, but is not normally varied to change the flow through the pump. When special arrangements such as transmissions have allowed the flow rate through the triplex to be changed (an approximately 2:1 ratio has been found to be desirable), such a variation requires either shutting down the well and modifying the cyclone or to very poor cleaning in the cyclone leading to excessive and expensive wear of the downhole pump (cyclones only clean properly if the flow is within about 10% of the rated value). As a result, conventional systems generally do not control the speed of the triplex pump, but instead bypass a portion of the flow through a throttling valve (the pressure is reduced from several thousand psi to approximately 100 psi by the throttling valve). The bypass fluid is then combined with the return fluid from the well.

Hydraulic pumping systems are described in, for example, U.S. Pat. Nos. 2,046,769, 2,119,737, and 2,593,729, issued to Coberly; U.S. Pat. Nos. 3,759,324 and 3,802,501, issued to Mecusker; and U.S. Pat. Nos. 3,709,292 and 3,782,463, issued to Palmour.

Although systems such as described in the aforementioned Pat. No. 3,802,501 have recirculated some fluid to improve cleaning of the fluid, apparently all of these systems have been used with triplex pumps driven at an essentially constant speed (i.e., by an AC motor).

SUMMARY OF THE INVENTION

It has been discovered that there are very significant changes in well conditions over a relatively short period of time and that a very substantial reduction in the cost of power for operating a hydraulic pumping unit (while still providing a proper cleaning of the downhole pump power fluid) can be made by using a cyclone feed pump, a flowback line, and a speed control means which can vary the speed at which the prime mover drives the above-ground pump in response to the particular well conditions. This allows the speed of the above-ground pump to be reduced whenever the well conditions make such a reduction appropriate which results in a decrease in the power bill (the power consumed by the cyclone feed pump is quite small compared to the power formerly wasted in bypassed fluid). Although the flow in the cyclone feed pump may, for example, be three times as much as the flow which otherwise would be bypassed, the feed pump head is only approximately 50 psi as opposed to a typical 2,000–3,000 psi head for the triplex pump. As the triplex pump power reduction is much greater than the power consumed by a cyclone feed pump, the total power requirement has been reduced. In one particular field, it is estimated that the use of this system will save $20,000 a month.

A speed control means is connected to the prime mover for controllably varying the speed at which the prime mover drives the above-ground pump. The cyclone feed pump outlet is connected to the inlet of the cyclone. The feed pump inlet is connected to receive the return fluid flow from the well. The cyclone feed pump is preferably sized to have a head approximately equal to the maximum rated pressure drop across the cyclone at the maximum rated cyclone inlet flow. The cyclone is preferably sized for a maximum flow out its overflow of slightly greater than the maximum flow through the triplex pump. The flowback line is connected from the cyclone overflow to the cyclone feed pump inlet.

Preferably, a controllable throttling means is connected between the cyclone underflow and the flowline and controls the flow from the cyclone underflow as a function of the differential pressure between the cyclone overflow and the cyclone underflow.

BRIEF DESCRIPTION OF THE DRAWINGS

A better understanding of the invention may be obtained by reference to the following drawings in which.

DESCRIPTION OF THE PREFERRED EMBODIMENTS

Figure 1:
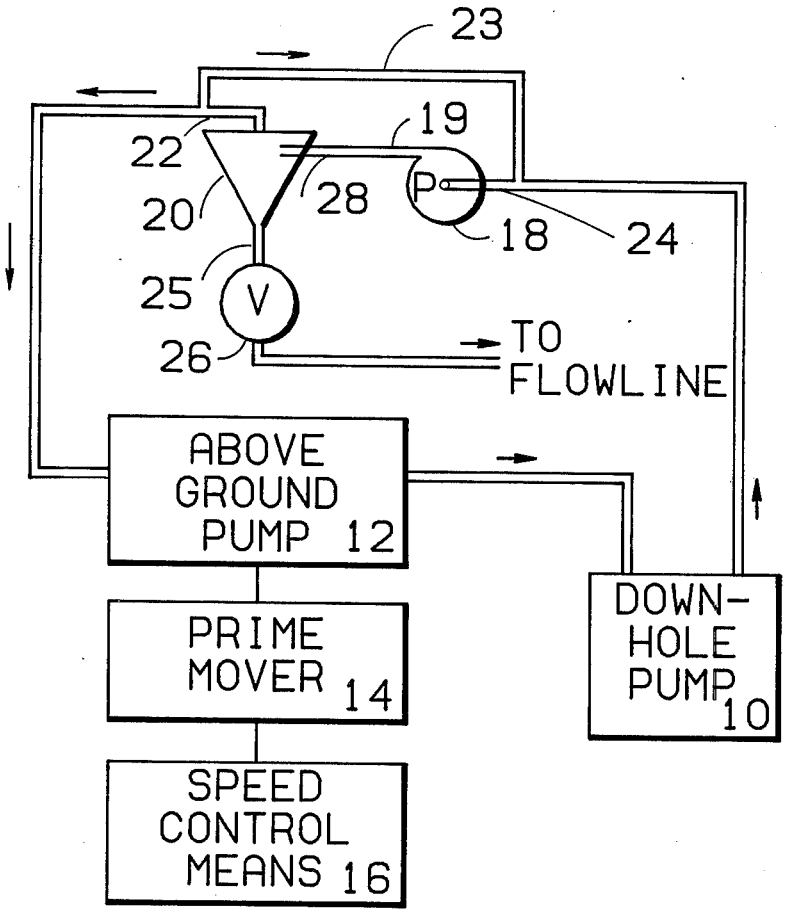
FIG. 1 is a schematic showing the general relationship of elements in a simple embodiment.

In FIG. 1, downhole pump 10 is powered by fluid from an above-ground pump 12. The speed at which the above-ground pump 12 is driven by prime mover 14 can be varied by the speed control means 16. The return fluid from downhole pump 10 is pumped by cyclone feed pump 18, whose outlet 19 is connected to cyclone separator 20. Most of the fluid comes out of the cyclone overflow 22 as conditioned fluid. At least some of the conditioned fluid from the cyclone overflow 22 goes to the inlet of the above-ground pump 12, while any remaining flow from the cyclone overflow 22 is recirculated through the flowback line 23, which is connected from the cyclone overflow 22 back to the cyclone feed pump inlet 24.

A portion of the cyclone fluid containing the solids goes out the cyclone underflow 25. Underflow valve 26 throttles the flow out cyclone underflow 25.

The demand signal for the speed control means can be determined based on well conditions, and preferably is a function of downhole pump hydraulic efficiency using two flow measurements (generally as described in the aforementioned U.S. application Ser. No. 742,060). Prime mover 14 and speed control means 16 combination can have various forms, including a gasoline engine with a throttle controller. Alternatively, the prime mover could be an AC motor supplied from a variable frequency power supply which is controlled from a demand signal based on well conditions (a variable frequency power supply is also discussed in the aforementioned application Ser. No. 724,060).

Another alternative is a speed control means which varies the speed of the above-ground pump in steps (i.e., an AC motor driving a four-speed mechanical transmission which, in turn, drives the above-ground pump) such that only a small amount of fluid need be bypassed (thus dissipating only a small amount of power). In such a system, the aforementioned downhole pump efficiency signal could, for example, be used to control a bypass valve and either a bypass flow measurement or a bypass valve position signal could be used to determine when to initiate a gear change in the transmission. Thus, for example, when the bypass valve opened to a certain degree, the transmission would be downshifted to slow the triplex pump. This decreases the load on the electric motor, reducing the current and results in a savings of electric power. In all of the alternative configurations, of course, slowing down the above-ground pump saves prime mover power.

Generally, the flow into the cyclone inlet 28 is to be kept relatively constant (within about +10%). This could be achieved by using a piston pump for the cyclone feed pump 18, driving the pump at a relatively constant speed (+10%) to keep the cyclone flow within the proper cleaning range. Piston pumps, however, generally have high maintenance when handling fluids containing solids. Preferably, cyclone feed pump 18 is a centrifugal pump. The head of centrifugal pump 18 at maximum flow (when the above-ground pump 12 is operated at maximum speed) should be approximately equal to (preferably slightly greater than) the pressure drop across cyclone 20 at the same flow conditions. Thus, even with the transmission in high gear, any flow in feedback line 23 is from the cyclone overflow 22 back to cyclone feed pump inlet 24. As the transmission is shifted into a lower gear, the flow through feed pump 18 and cyclone 20 will decrease slightly and the flow in the flowback line 23 with increase.

Figure 2:
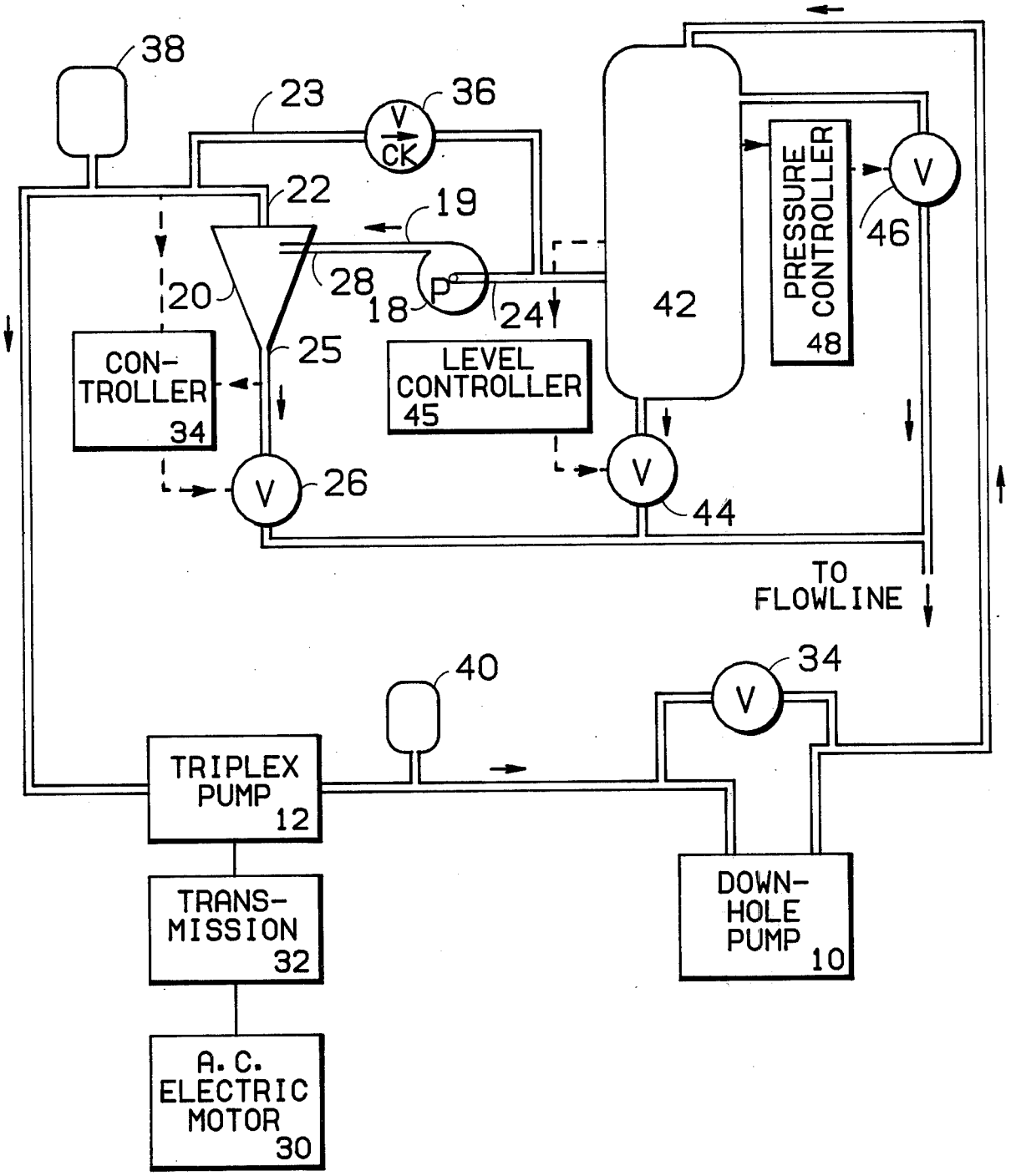
FIG. 2 is a schematic of the preferred embodiment.

FIG. 2 shows a configuration of a hydraulic pumping unit with several preferred features. An electric motor 30 drives the triplex pump 12 through a transmission 32. This arrangement is convenient because of its compatibility with presently available commercial units and because of the relatively low cost of the transmission 32. Because transmission 32 gives step changes in speed of triplex pump 12, a bypass valve 34 is used to bypass a portion of the fluid around downhole pump 10 to provide a fine control of downhole pump speed.

Cyclone feed pump 18 is a relatively inexpensive centrifugal pump. This feed pump 18 can be sized to provide a head of about 20–60 psi (depending on the cyclone characteristics) at a flow of about 1.15–1.40 times the maximum flow of triplex pump 12. Typically, transmission 32 will have a gear ratio from high gear to low gear of about 2.

The flow out cyclone underflow 25 can be regulated by under-flow controller 34 based on the differential pressure between cyclone overflow 22 and cyclone underflow 25, and in typical cyclones this flow should be maintained at between 5 and 25% of the inlet flow to the cyclone (preferably, about 15%).

As gears are changed in the transmission, the flow through triplex pump 12 will change in essentially the same ratio as the gear ratio change. The inlet flow of the cylone will drop slightly and the flow through flowback line 23 will go up significantly as triplex pump 12 is slowed down.

For example, cyclone feed pump 18 may have a head of 45 psi with triplex pump 12 operating at maximum speed (the transmission in high gear) and with a cyclone pressure drop of 44 psi. Then with a pressure differential across the flow back line 23 of about 1 psi, the flowback line 23 would have a relatively small flow (perhaps 10% of the flow through the triplex pump). Shifting transmission 32 into low gear will reduce the flow through triplex pump 12 to about half and the flow through cyclone feed pump 18 will drop by about 10% and the feed pump's head will typically rise to about 50 psi. The pressure drop across cyclone 20 will fall to approximately 35 psi and the pressure across flowback line 23 will increase to approximately 15 psi. The flow in line 23 increases to approximately 80% of the flow through triplex pump 12 (approximately 40% of the original flow through triplex pump 12 when it was in high gear).

From the foregoing illustration, it can be seen that the configuration of this invention provides only a relatively small change in flow through cyclone 20 despite a 2:1 change in the flow through the triplex pump 12. Thus, the gears in transmission 32 can be changed (with the resultant power savings for the AC electric motor 30) while maintaining the flow in the range which gives good cleaning in cyclone 20, clean fluid being essential to minimize costly wear of the down pump 10. The quality of fluid cleaning is actually improved as a portion of the fluid is recirculated and recleaned.

Preferably, a check valve 36 is placed in flowback line 23 to prevent contaminated fluid from bypassing cyclone 20 during transients caused, for example, by shifting gears in transmission 32. A surge tank 38 is located on cyclone overflow 22 (this is in addition to normal surge tank 40 which has been used on the triplex outlet) to minimize pressure fluctuations both due to the shifting of transmission 32 and the normal pulsations in triplex pump 12. It is possible to slightly reduce the size of the cyclone feed pump motor when check valve 36 is used, as even if the head of cyclone feed pump 18 is slightly less than the pressure drop across the cyclone, contaminated fluid will still not bypass the cyclone.

A throttling valve can be used in flowback line 23. This can be a manually operated valve used to initially set up the system to, for example, adjust the flow in flowback line 23 to about 10% of triplex pump flow. Alternately, the throttling valve can be automatically controlled to maintain, for example, a constant flow through, or a constant pressure drop across, cyclone 20. This controlled throttling is not normally required, but can be useful with cyclones which are especially sensitive to flow variations or when the speed of the triplex is varied through an unusually wide range.

Underflow throttling valve 26 provides a controllable throttling means connected between cyclone underflow 25 and the flowline. This flow is preferably controlled as a function of pressure at cyclone underflow 25, and more preferably is controlled to maintain a constant differential pressure between cyclone overflow 22 and cyclone underflow 25. The pressure at cyclone underflow 25 can be set to be several psi, i.e., 5 psi, below the pressure at cyclone overflow 22. For good cleaning, the flow through cyclone underflow 25 should be between 5 and 25% of the inlet flow to cyclone 20 and this flow is a function of the pressure differential between cyclone underflow 25 and cyclone overflow 22.

It should be noted that the above described method of controlling the position of underflow valve 26 provides self-cleaning. If the solids coming out cyclone underflow 25 start to clog up in underflow valve 26 or elsewhere in the line leading to the flowline, the pressure at cyclone underflow 25 starts to rise and the controller 34 opens underflow valve 26 to increase the flow. This increased flow will generally flush out the line before it is completely clogged and avoids plugging up of the line.

In many wells, especially those whose return fluid contains a significant amount of gas, it is preferable to use separator vessel 42. This vessel has an input connected to receive the return fluid from the well and has an output connected to cyclone feed pump 18. Often, wells return more fluid than is convenient to discharge through cyclone underflow 25, and thus valve 44 is provided to discharge fluid from separator vessel 42 to the flowline. Valve 44 can be conveniently controlled by level controller 45, the combination acting as a liquid level control means to maintain a predetermined level of liquid in separator vessel 42. Having a gaseous zone above the liquid fluid level in separator vessel 42 is convenient as it provides for better stripping of gases from the return fluid and also provides for better pressure control. Valve 46 is preferably connected into the gaseous zone of separator vessel 42. Pressure controller 48 and valve 46 acting as a pressure controlling means with controller 48 opening valve 46 when the pressure in separator vessel 42 exceeds a predetermined level. This will allow gas to flow to the flowline and reduces the pressure without affecting the liquid level. Having a gas zone in the system avoids the large pressure transient which would result if valve 46 were opened when the system was completely filled with liquid.

Using cyclone feed pump 18 results in the pressure in cyclone 20, and the gas in the return fluid will generally come off in separator vessel 42. Thus, the difficulty with gas coming off in the cyclone which is generally encountered in conventional systems is avoided (in conventional systems, the cyclone runs at a slightly lower pressure than the separator vessel and thus additional gas is generally liberated in the cyclone).

It should be noted that the arrangement of this invention allows a standard unit to be used on various wells with different charactristics, which is convenient even if conditions in a particular well happen to be relatively constant. Initial setup time is minimized as the system can adapt to the particular well conditions, and power usage is minimized even though the unit is oversized for the particular well.

The invention is not to be construed as limited to the particular embodiments described herein, since these are to be regarded as illustrative rather than restrictive. The invention is intended to cover all configurations which do not depart from the spirit and scope thereof.

We claim:

1. In combination with a well-fluid hydraulic pumping unit of the type wherein a prime mover drives an above-ground pump to supply a flow of pressurized fluid, wherein at least some of said pressurized fluid is used as power fluid for a downhole hydraulically actuated pump, which downhole pump returns fluid to the surface wherein at least some of said return fluid is introduced as cyclone flow into the input of a cyclone separator, and wherein a portion of said cyclone flow exits the cyclone overflow as cleaned fluid and is available for use as power fluid, and the remainder of said cyclone flow exits the cyclone underflow and is sent to a flowline, the improvement which comprises:

a. speed control means connected to said prime mover for controllably varying the speed at which said prime mover drives said above-ground pump;

b. a cyclone feed pump having an inlet and an outlet, wherein said outlet is connected to said cyclone inlet and wherein said feed pump inlet is connected to receive said return fluid, and c. a flowback line connected from said cyclone overflow to said cyclone feed pump inlet, whereby the speed of the above-ground pump can be changed without adversely affecting the cleaning by the cyclone.

2. The combination of claim 1 wherein said prime mover is an AC electric motor and said speed control means comprises a transmission which connects said motor and said above-ground pump, and said cyclone feed pump is sized to have a head approximately equal to the maximum rated pressure drop across the cyclone at a flow equal to the maximum rated cyclone flow.

3. The combination of claim 2, wherein the cyclone feed pump and the cyclone are both sized for differential pressures of about 20–60 psi at a flow of about 1.15–1.40 times the maximum flow of the above-ground pump.

4. The combination of claim 2, wherein a controllable throttling means connects said cyclone underflow with said flowline for controlling the flow from the cyclone underflow as a function of the pressure at the cyclone underflow.

5. The combination of claim 4, wherein said controllable throttling means controls the flow from the cyclone underflow as a function of the differential pressure between the cyclone overflow and the cyclone underflow.

6. The combination of claim 5, wherein a check valve is mounted in said flowback line to allow flow only in the direction from the cyclone overflow toward the cyclone feed pump inlet, whereby a flow in said flowback line of unconditioned fluid from the cyclone feed pump inlet toward the cyclone overflow is prevented.

7. The combination of claim 6, wherein a separator vessel is used, said separator vessel having an input connected to receive the return fluid from the well and having an output connected to said cyclone feed pump.

8. The combination of claim 7, wherein a pressure controlling means is connected to said separator vessel, said pressure controlling means being capable of controllably discharging fluid from said separator vessel to said flowline, and wherein a liquid level control means is connected to said separator vessel, said liquid level control means being capable of controllably discharging liquid from said separator vessel to said flowline.

9. The combination of claim 8, wherein a surge vessel is connected to said cyclone overflow.

10. The combination of claim 1, wherein the speed of said above-ground pump is varied as a function of well conditions.

* * * * *

UNITED STATES PATENT OFFICE
CERTIFICATE OF CORRECTION

PATENT NO. : 4,066,123

DATED : January 3, 1978

INVENTOR(S) : David R. Skinner, Marvin W. Justus, and Miles L. Sowell

It is certified that error appears in the above-identified patent and that said Letters Patent are hereby corrected as shown below:

Column 4, line 5, "feedback" should read --flowback-- .

Column 6, line 6 and 7, after "in"(line 6, second occurrence) and before "cyclone" (line 7) insert --separator vessel 42 being slightly lower than the pressure in-- .

Signed and Sealed this

Ninth Day of May 1978

[SEAL]

Attest:

RUTH C. MASON
Attesting Officer

LUTRELLE F. PARKER
Acting Commissioner of Patents and Trademarks